US006543269B2

(12) United States Patent
Beuter et al.

(10) Patent No.: US 6,543,269 B2
(45) Date of Patent: Apr. 8, 2003

(54) APPARATUS FOR FORMING COMPONENTS FROM CONTINUOUS STOCK

(75) Inventors: Herman A. F. Beuter, Three Rivers, MI (US); James A. Peter, Portage, MI (US); Timothy M. Brockelbank, Three Rivers, MI (US)

(73) Assignee: HBE Engineering, INC, Three Rivers, MI (US)

( * ) Notice: Subject to any disclaimer, the term of this patent is extended or adjusted under 35 U.S.C. 154(b) by 0 days.

(21) Appl. No.: 09/850,125

(22) Filed: May 7, 2001

(65) Prior Publication Data

US 2002/0162380 A1 Nov. 7, 2002

(51) Int. Cl.[7] ..... B21D 37/04
(52) U.S. Cl. ..... 72/446; 72/404
(58) Field of Search ..... 72/404, 446

(56) References Cited

U.S. PATENT DOCUMENTS

| | | | | |
|---|---|---|---|---|
| 3,709,023 A | | 1/1973 | Thode | |
| 3,807,215 A | | 4/1974 | Olsen et al. | |
| 4,304,347 A | | 12/1981 | Finzer et al. | |
| 4,586,357 A | | 5/1986 | Allweier et al. | |
| 4,607,571 A | | 8/1986 | Finzer et al. | |
| 5,216,913 A | * | 6/1993 | Post | 72/404 |
| 5,271,261 A | * | 12/1993 | Bihler et al. | 72/446 |
| 5,390,574 A | * | 2/1995 | Schorn | 72/21.5 |
| 5,613,396 A | * | 3/1997 | Futamura et al. | 72/404 |

FOREIGN PATENT DOCUMENTS

| | | | | |
|---|---|---|---|---|
| GB | 2 064 402 | * | 6/1981 | 72/404 |

* cited by examiner

*Primary Examiner*—Lowell A. Larson
(74) *Attorney, Agent, or Firm*—MacMillan, Sobanski & Todd, LLC

(57) ABSTRACT

An apparatus for forming components from continuous stock includes a stock feeder, a tool bed, a source of pressured fluid and a control panel. The tool bed has a plurality of horizontally extending tooling rails mounted on a vertical front surface for selectively and releasably attaching one or more of a plurality of tool pallets. Each tool pallet has one or more tools for performing forming operations on stock received from the stock feeder. Tool actuators mounted on the pallet are connected to the fluid source through valves operated by the control panel. The tool pallets are easily replaced for maintenance or changeover to a new component. The control panel generates a plurality of screens for programming, testing and automatically running programs consisting of forming steps to be performed.

20 Claims, 11 Drawing Sheets

APPARATUS FOR FORMING COMPONENTS FROM CONTINUOUS STOCK

BACKGROUND OF THE INVENTION

The present invention relates generally to an apparatus for forming components from a continuous stock of wire, strip or tube.

Modern wire forming and spring making machines combine a wire feeding mechanism, multiple cam actuated forming tools to bend the wire in required different directions and a cutoff tool to sever the finished part from the wire stock. However, when a change is required or a new part is to be manufactured, it is a costly and time-consuming process to either adjust the operation of the tools or replace the tools for the current part with a new set of tools for the new part.

Historically, wire forming and spring making companies have pursued speed as the answer for much needed productivity improvements. But in many cases, speed alone may compound existing quality and inventory related issues. Complicated parts requiring secondary or multiple operations will accumulate at high speed during the primary operation, only to wait in staging areas to be completed with slower operations such as coining, trimming, looping, broaching, bending, chamfering, etc.

Naturally, optimum speed will always be a basic issue, but for many production parts this should not be the main focus. Since no component can be completed faster than its slowest operation, starting there and working backwards makes sense when establishing the best production process. Next, utilizing automation to tie these operations together reduces labor, inventory and the cost of quality. Redundant inspections will be eliminated.

SUMMARY OF THE INVENTION

The present invention concerns a modular forming apparatus for forming components from continuous stock supplied by a stock feeder. A tool bed mounted on a base has a plurality of horizontally extending tooling rails mounted on a vertical front surface for selectively and releasably attaching one or more of a plurality of tool pallets. A source of pressured fluid (hydraulic and/or pneumatic) is connected to actuators for the tools for performing forming operations on stock received from the stock feeder. The tool actuators mounted on the pallet are connected to the fluid source through valves operated by a control panel. The tool pallets are easily replaced for maintenance or changeover to a new component. The control panel generates a plurality of screens for programming, testing and automatically running programs consisting of forming steps to be performed.

In response to a growing demand for equipment which can automatically produce completed wire, strip or tube components, the present invention is a unique production machine that enables the user to eliminate costly secondary operations by capturing and transferring components during the production process.

Unlike conventional cam driven mechanical systems such as fourslides or other geared forming machines, the modular machine according to the present invention is not limited by cam rotation, tool bed space or slide position. A vertical machine bed allows automated in-line production that can include operations originally performed as secondaries.

Whereas mechanical cam actuated forming machines have fixed tool paths that place limits on tool positioning, the modular machine according to the present invention utilizes hydraulic or pneumatic cylinders for tool actuation, allowing almost infinite tool positioning options. The use of keyed tooling rails on a bed allows the mounting of slides and form-tools above, below, behind or in front of the wire line, at any required angle. Multi-plane forming is never a problem.

Another advantage of the hydraulic forming system according to the present invention is the ability to increase or decrease the forming power for each individual slide simply by selecting the required, hydraulic cylinder tonnage. Whereas typical slide machines have identical tonnage on every slide, the modular machine enables the technician to have additional power when needed.

Since cams are limited to their dwell (normally fast in/out tool movement) and 360° rotation, slide time on the tool is severely limited. In the case of many spring steel parts, the hydraulically actuated cylinder slide of the present invention can actually dwell (using time delays) on a specific point, creating a "setting" action for the tool. This is particularly useful for critical dimensions or compensating for material spring-back.

Also, the speed of entry or retraction can be set for each slide of the present invention simply by adjusting the individual flow controls for each valve. This feature is particularly important when the technician wishes to prevent a long material segment from whipping during the forming process. By slowing the cylinder action, the material will move smoothly into position, assuring the success of the following operation.

Designers no longer need to worry about completing a specific part within the normally required 360° of cam rotation. This constant limitation is eliminated through the use of cylinder actuated slides and tooling in the modular machine according to the present invention. Timing becomes less a factor of tool design and more of a total process issue.

Through the use of a touch screen interface or MMI (Man-Machine-Interface) for programming, designers can "fire" tools independently, in any sequence or in any combination, during any step of the setup process. Any machine input may be actuated on demand, simplifying and shortening the setup and tryout process. Repeated "hits" can be made with individual tools without cycling the machine through any other phase of the program. Once a step or operation is satisfactorily completed, the tool designer or technician can move on to the next operation. After all of the individual operations are completed, they can be tried in partial or total sequence until the final part is correct.

Ultimately, after the tooling is proven station by station, the transfers are installed to move the component from operation to operation, across the face of the machine. Successful transfer to, and completion of each additional operation, is achieved by never losing control of the part.

The modular machine according to the present invention also includes the ability to run two parts at the same time. By placing feed systems on both sides of the machine, the machine can produce two identical or different parts as needed. This feature is often used to increase capacity without adding another machine. The dual feed system also provides the opportunity to assemble the two components by transferring one to the other.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
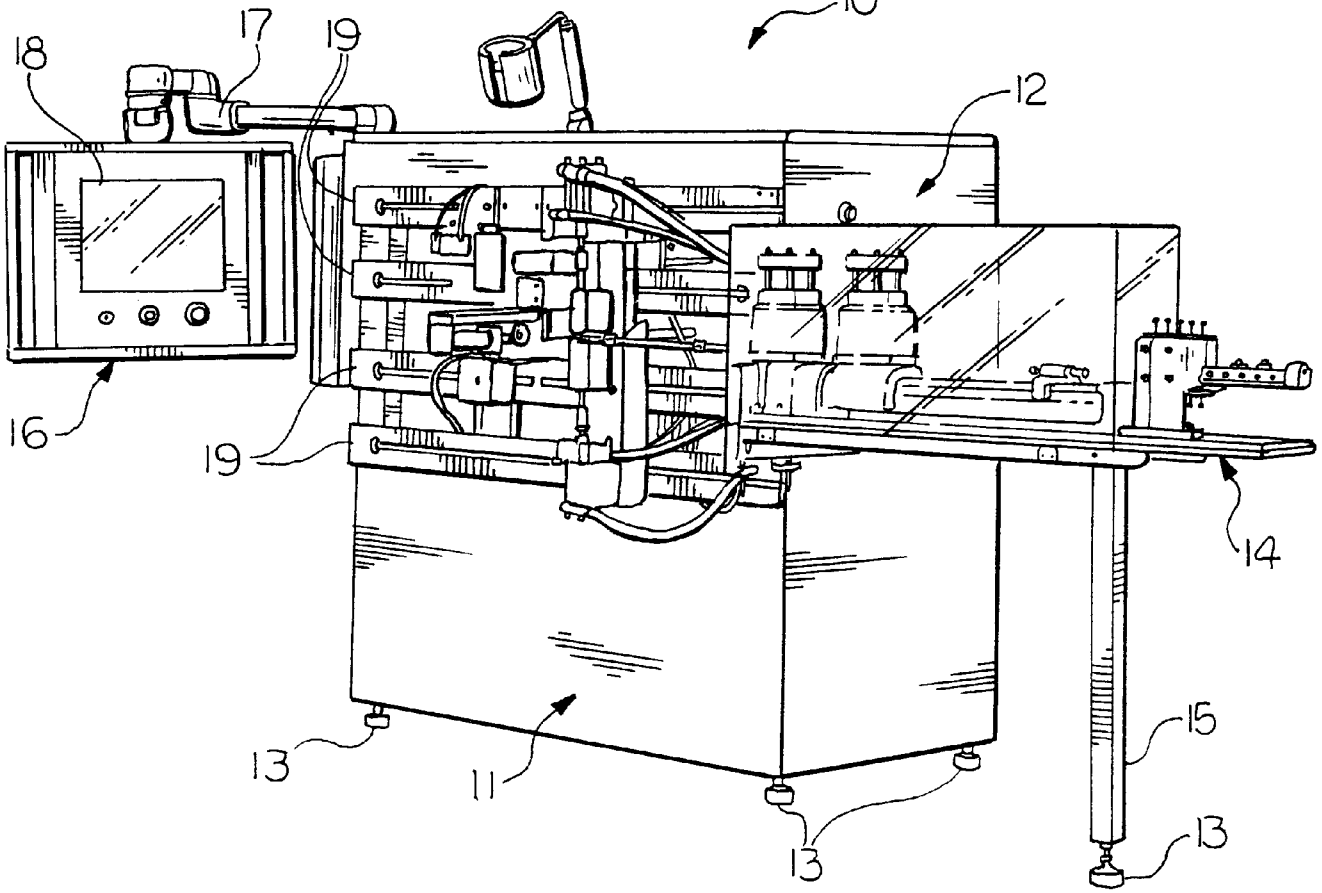
FIG. 1 is a perspective view of a component forming apparatus in accordance with the present invention.

There is shown in FIG. 1 a component forming apparatus 10 according to the present invention. The apparatus 10 includes a box-like ground-engaging base 11 supporting a box-like tool bed 12. The base 11 has a plurality of leveling feet 13 for leveling the apparatus 10 upon installation. To the right of the tool bed 12 is positioned a horizontally extending stock feeder 14 that is attached at one end to the tool bed and is supported adjacent an opposite end by a downwardly extending leg 15 having a leveling foot 13 at the lower end thereof. The stock feeder 14 typically unwinds coiled metal stock (not shown) and straightens it before feeding the stock to tools mounted on the tool bed 12 as required to make the desired component. Depending upon the component to be formed, the stock can be wire, strip or tube in configuration.

A control panel 16 is suspended from a movable arm 17 extending from a top face of the tool bed 12. As explained below, the control panel 16 permits an operator to set up the program of operations to be performed to form a selected component, test the program and control production. The component forming apparatus 10 is a user-friendly system that includes quick change-over from job to job, the option to use palletized modular tooling, easy to understand programming format, and part program storage retrieval capability, utilizing a state-of-the-art touch screen 18 built into the control panel.

Figure 2:
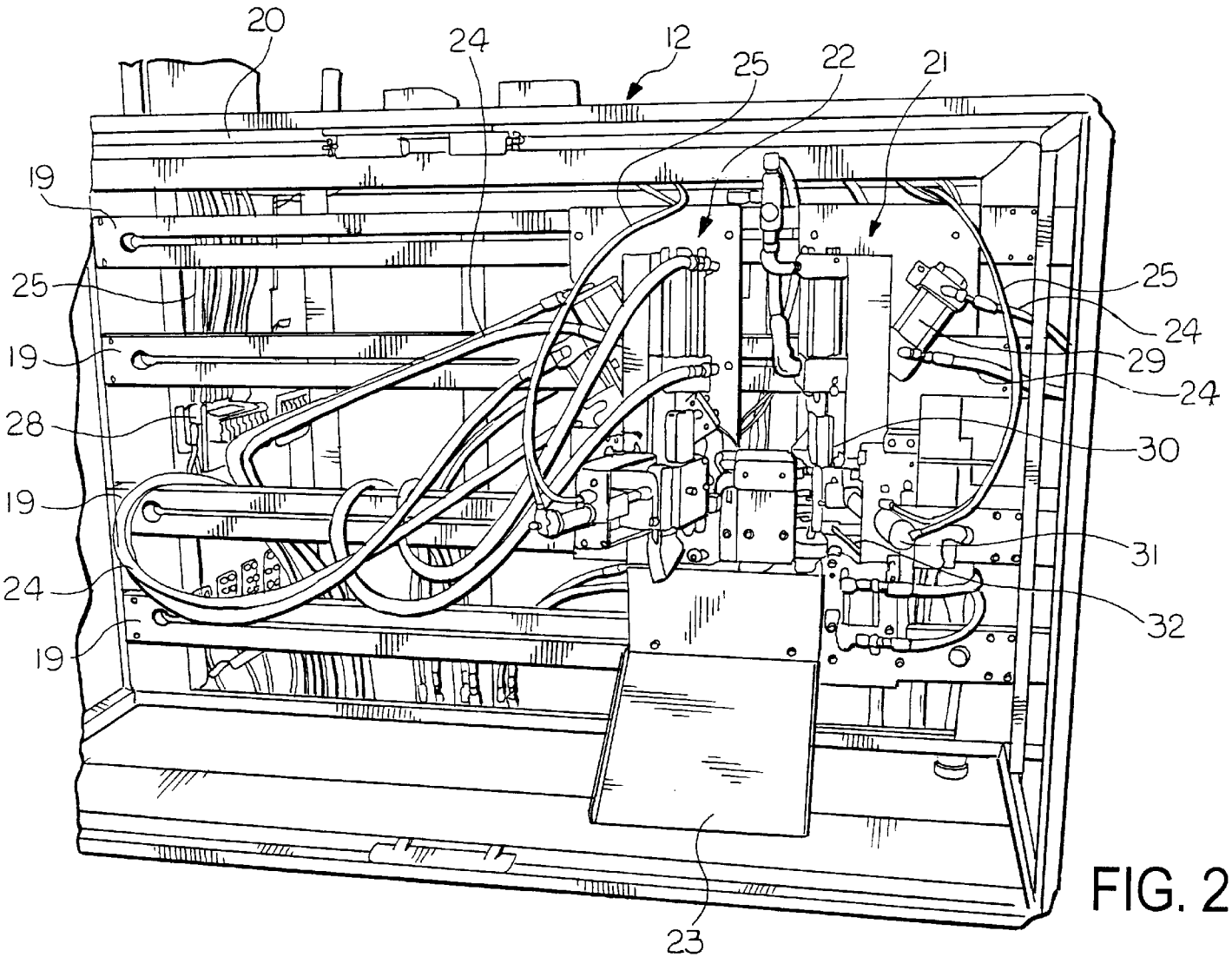
FIG. 2 is a front elevation view of the tool bed portion of the component forming apparatus shown in FIG. 1.

As shown in FIGS. 1 and 2, four generally horizontally extending tooling rails 19 are mounted on an open front face of the tool bed 12 with opposite ends of the rails attached to a frame 20 of the tool bed. The rails 19 are approximately equally spaced in a vertical direction and slotted for mounting modular tool pallets in any of a plurality of selected positions. As explained below reference to FIG. 3, the rear surfaces of the rails 19 are accessible through a rear face of the tool bed 12 to permit free access for mounting tool pallets on both the front and rear surfaces of the rails.

As best shown in FIG. 2, a first tool pallet 21 is mounted on the rails 19 adjacent a right side of the tool bed 12 to receive stock from the stock feeder (not shown) located to the right thereof and perform at least one forming operation. A second tool pallet 22 is mounted on the rails 19 to the left of the first tool pallet 21 to perform at least another forming operation on the stock. A component guide pallet 23 is mounted on the rails 19 below the tool pallets 21 and 22 to direct completed components to a collection box (not shown) or the like. Passing between the rails 19 are a number of hydraulic lines 24 and pneumatic lines 25 to supply pressured fluid to operate various tool actuators mounted on the pallets 21 and 22.

Figure 3:
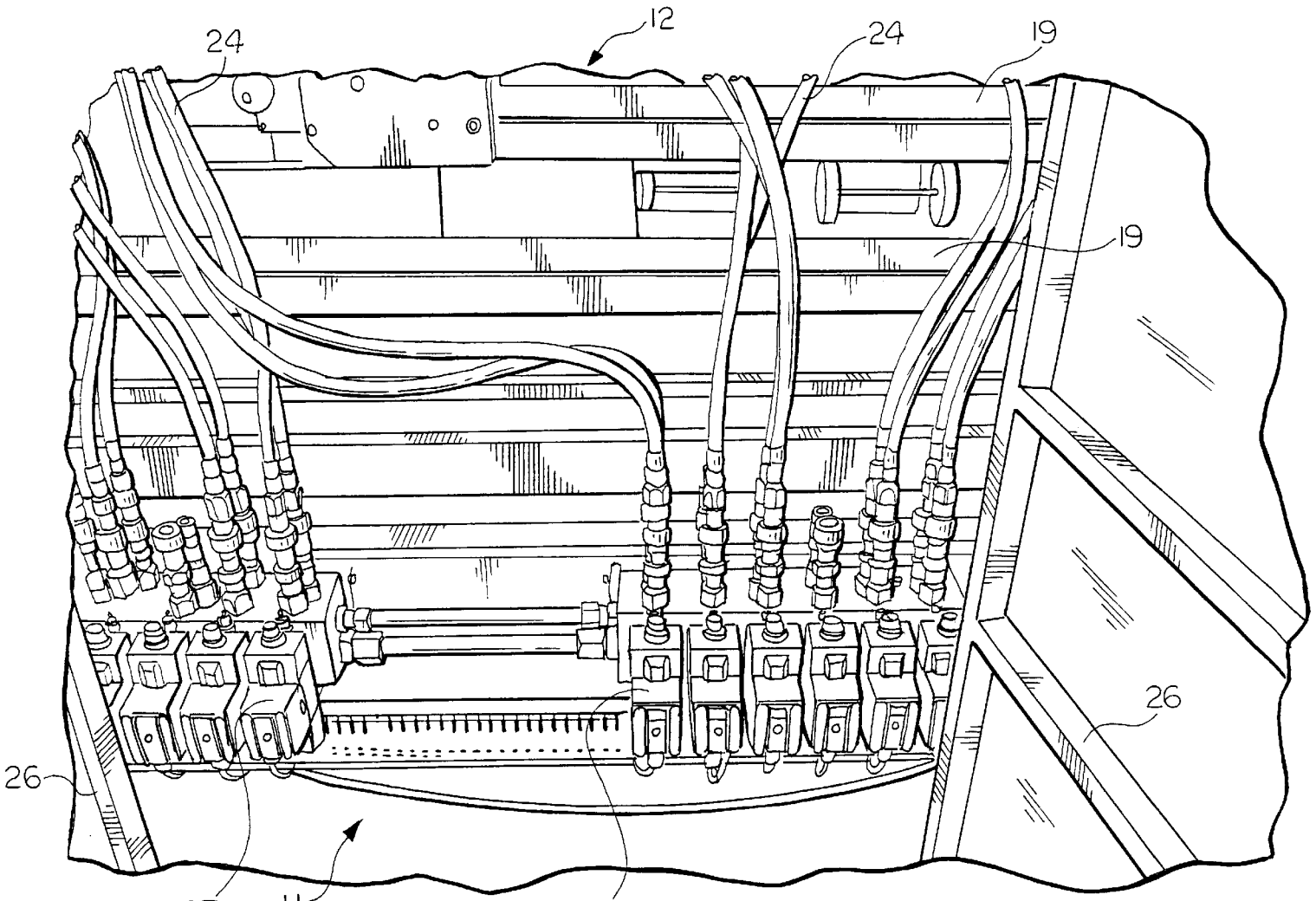
FIG. 3 is a rear elevation view of the tool bed and base portions of the component forming apparatus shown in FIG. 1.

FIG. 3 is a rear view of the component forming apparatus 10 with a pair of doors 26 open to expose the rear surfaces of the lower rails 19 and a plurality of solenoid controlled hydraulic valves 27 mounted in the base 11. The valves 27 can be double valves to each control one double-acting hydraulic operation or two single-acting hydraulic operations. The valves 27 are connected between the hydraulic lines 24 and a source of hydraulic fluid (not shown). In addition, as shown in FIG. 2, a plurality of pneumatic valves 28 are mounted on the inside surface of a left side face of the tool bed 12. The valves 28 can be double valves to each control one double-acting pneumatic operation or two single-acting pneumatic operations. The valves 28 are connected between the pneumatic lines 25 and a source of compressed air (not shown).

As an example of the hydraulic and pneumatic circuits for controlling the tools, a hydraulic actuator 29 is shown in FIG. 2 mounted on the first tool pallet 21. The actuator 29 is connected to a pair of the hydraulic lines 24 and is mechanically coupled to a component forming tool 30 also mounted on the tool pallet 21. Similarly, a pneumatic actuator 31 is mounted on the first tool pallet 21. The actuator 31 is connected to a pair of the pneumatic lines 25 and is mechanically coupled to another component forming tool 32 also mounted on the tool pallet 21.

Figure 4:
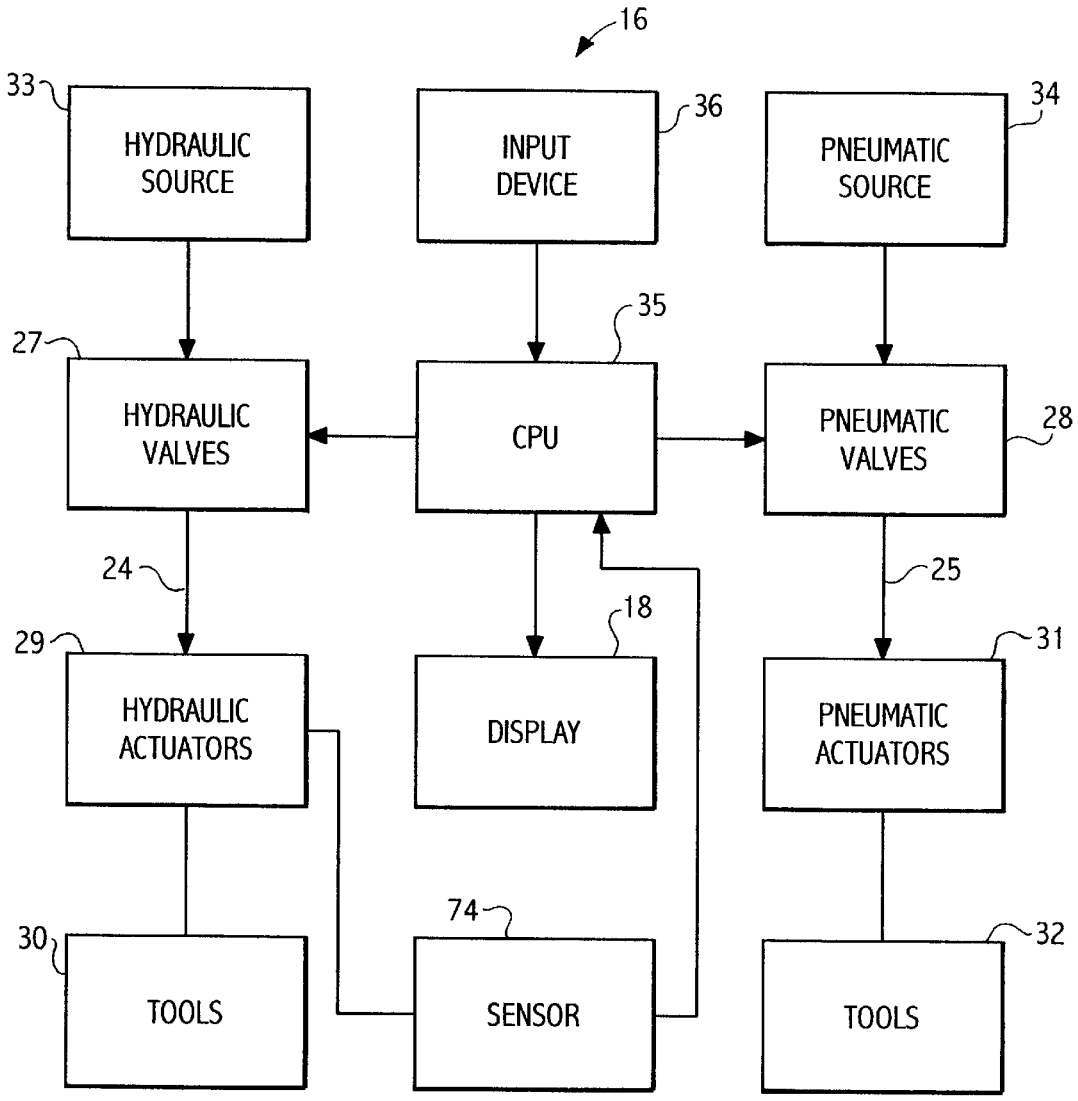
FIG. 4 is a schematic view of the control system for the component forming apparatus shown in FIG. 1.

A control system for the component forming apparatus 10 is shown in FIG. 4. A source of pressured hydraulic fluid 33 is connected to each of the hydraulic valves 27. Each of the hydraulic valves 27 is connected to an associated one of the hydraulic actuators 29 through one or two of the hydraulic lines 24. Each of the hydraulic actuators 29 is coupled to an associated component forming tool like the tool 30. In a similar manner, a source of pressured pneumatic fluid 34 is connected to each of the pneumatic valves 28. Each of the pneumatic valves 28 is connected to an associated one of the pneumatic actuators 31 through one or two of the pneumatic lines 25. Each of the pneumatic actuators 31 is coupled to an associated component forming tool like the tool 32.

The control panel 16 includes a CPU 35 that has outputs connected to the display 18, the hydraulic valves 27 and the pneumatic valves 28. The CPU 35 runs a stored program that controls the automatic operation of the valves 27 and 28 to form desired components. A human operator can use an input device 36 connected to an input of the CPU 35 to change a stored program, store a new program and manually operate each of the valves 27 and 28 during a setup or troubleshooting mode of operation. The input device 36 can be in the form of soft keys generated on the display 18 or a keyboard/key pad. The control panel 16 can be a Model SLC 5/03 control processor (35) and PowerView 1000 touch screen (18) both manufactured by Allen Bradley.

Component part programming screens generated on the display 18 present the operator with an easy to understand spreadsheet format with each line representing one step in the forming process. The operator can select which outputs will be turned on and which outputs will be turned off during each step. Time delays between these steps are also user selectable, from 0.01 seconds to 99.99 seconds. "Position Sensing" is a built in, selectable feature that can be toggled "On " for any output. This feature allows the operator to set which outputs need sensor confirmation of position. The system will wait for the appropriate sensor input, before proceeding to the next step. If the system doesn't receive the input, it will flash an alarm screen, indicating which output sensor to check. Set-up of tooling is made easier with a "Force Mode", allowing the user to "Force" on or off any output or group of outputs to check tooling position.

Figure 5:
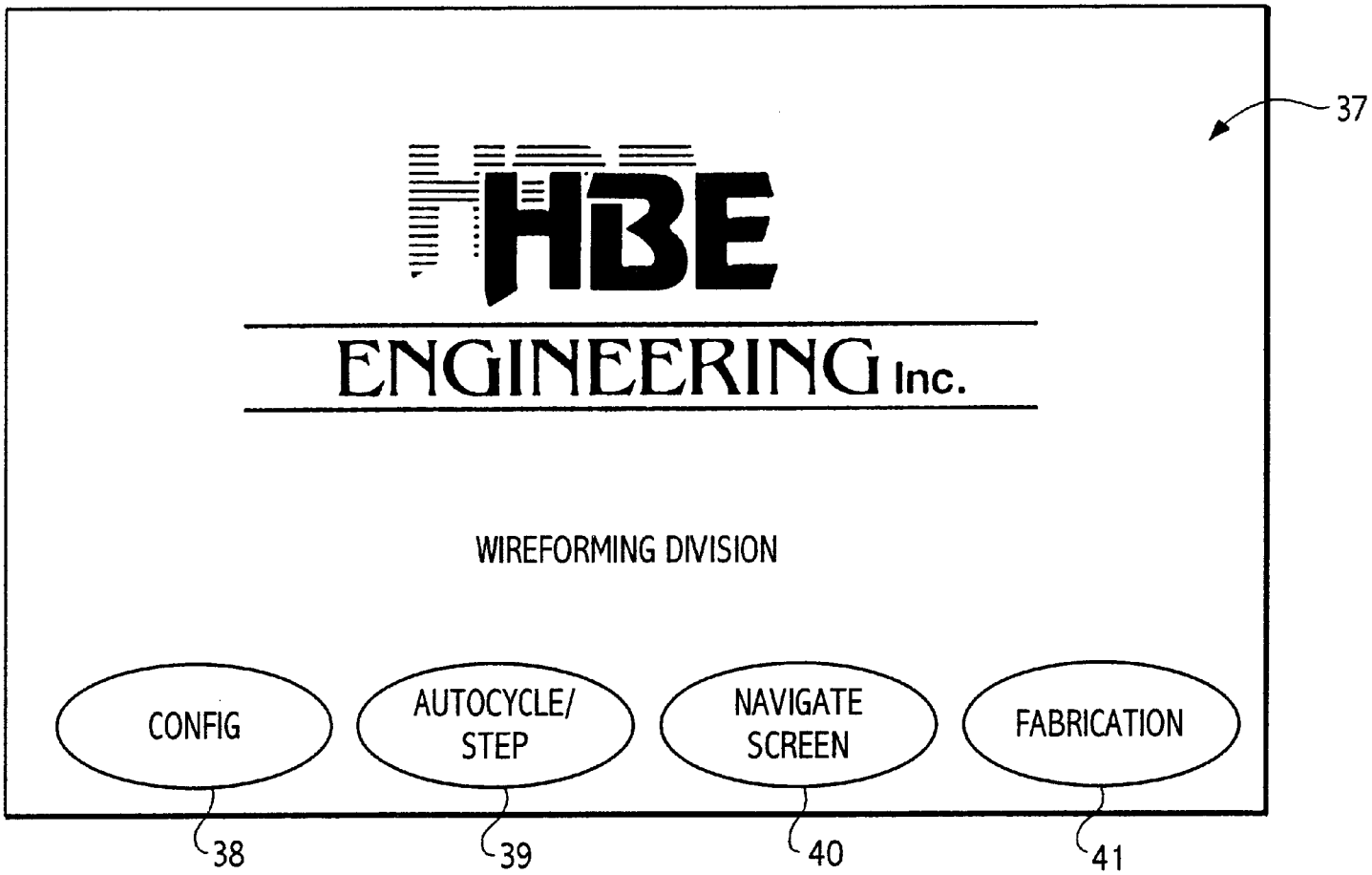
FIGS. 5–11 are various screens generated on the display of the component forming apparatus shown in FIG. 1.

When the component forming apparatus 10 is powered on, an "Initial" screen 37 is generated on the display 18 as shown in FIG. 5. The "Initial" screen provides to the operator navigation links to: a "Config" screen via a touch button 38; an "AutoCycle/Step" screen via a touch button 39; a "Navigate" screen via a touch button 40; and a "Fabrication" screen via a touch button 41. The "Config." screen is simply a setup screen for the control panel 16. The "AutoCycle/Step" screen is the main operating screen for the apparatus 10. The "Navigate" screen is the navigation hub for all program/operator screens. The "Fabrication" screen is the first of twenty-four part programming screens.

Figure 6:
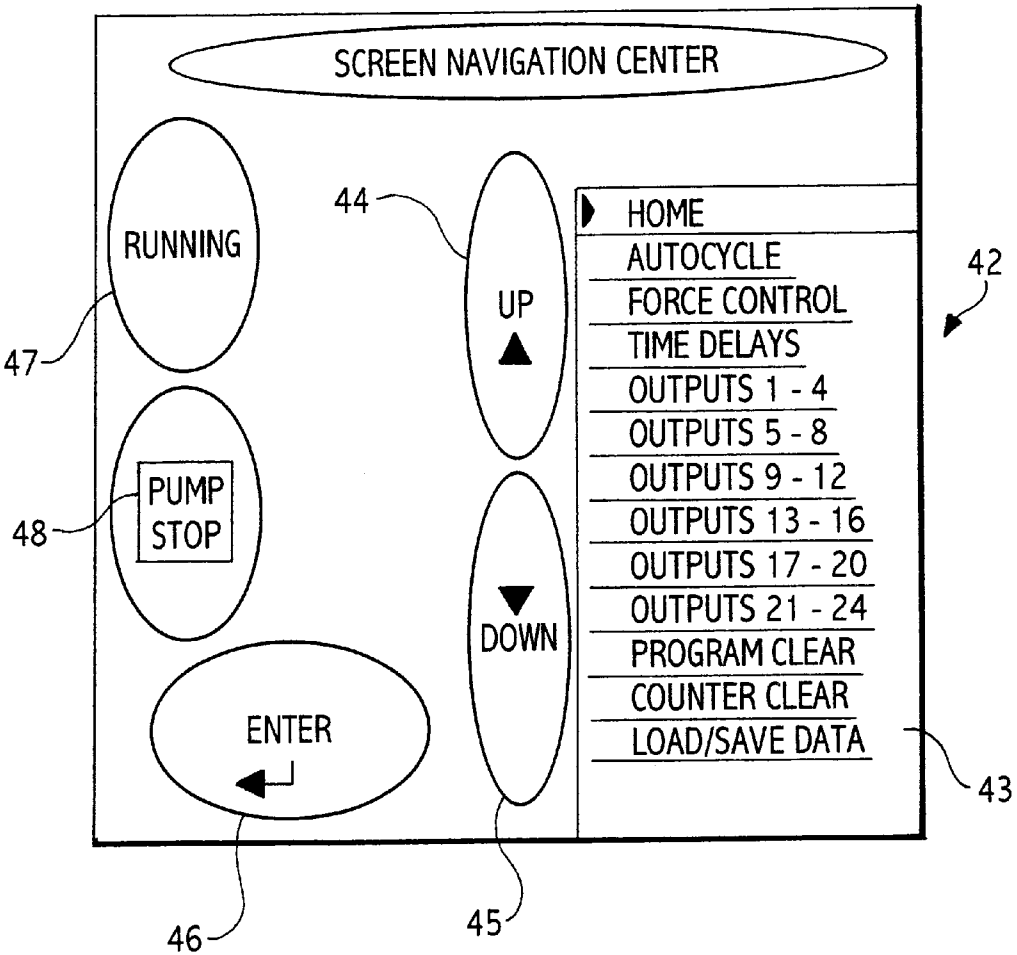

When the touch button 40 on the "Initial" screen 37 is touched by the operator, the display changes to a "Navigate" screen 42 as shown in FIG. 6. The "Navigate" screen allows quick access to all screens by providing a menu of available screens 43, an "Up" touch button 44 and a "Down" touch button 45 for moving in the menu and an "Enter" touch button 46 for selecting the highlighted screen identification. Also, included on this screen 42 are a "Pump Start" touch button 47 and a "Pump Stop" touch button 48. The "Pump Start" button 47 reads "Pump Start"(not shown) when the pump is not running, and changes to "Running"(shown) after it is pushed, and the hydraulic pump motor begins running. The "Pump Stop" button 48 reads "Pump Stopped" (not shown) with flashing text when the pump motor is not running. By pressing the "Up" or "Down" buttons to highlight the screen that you wish to navigate to and pressing "Enter", the screen display will change to the requested one.

Figure 7:
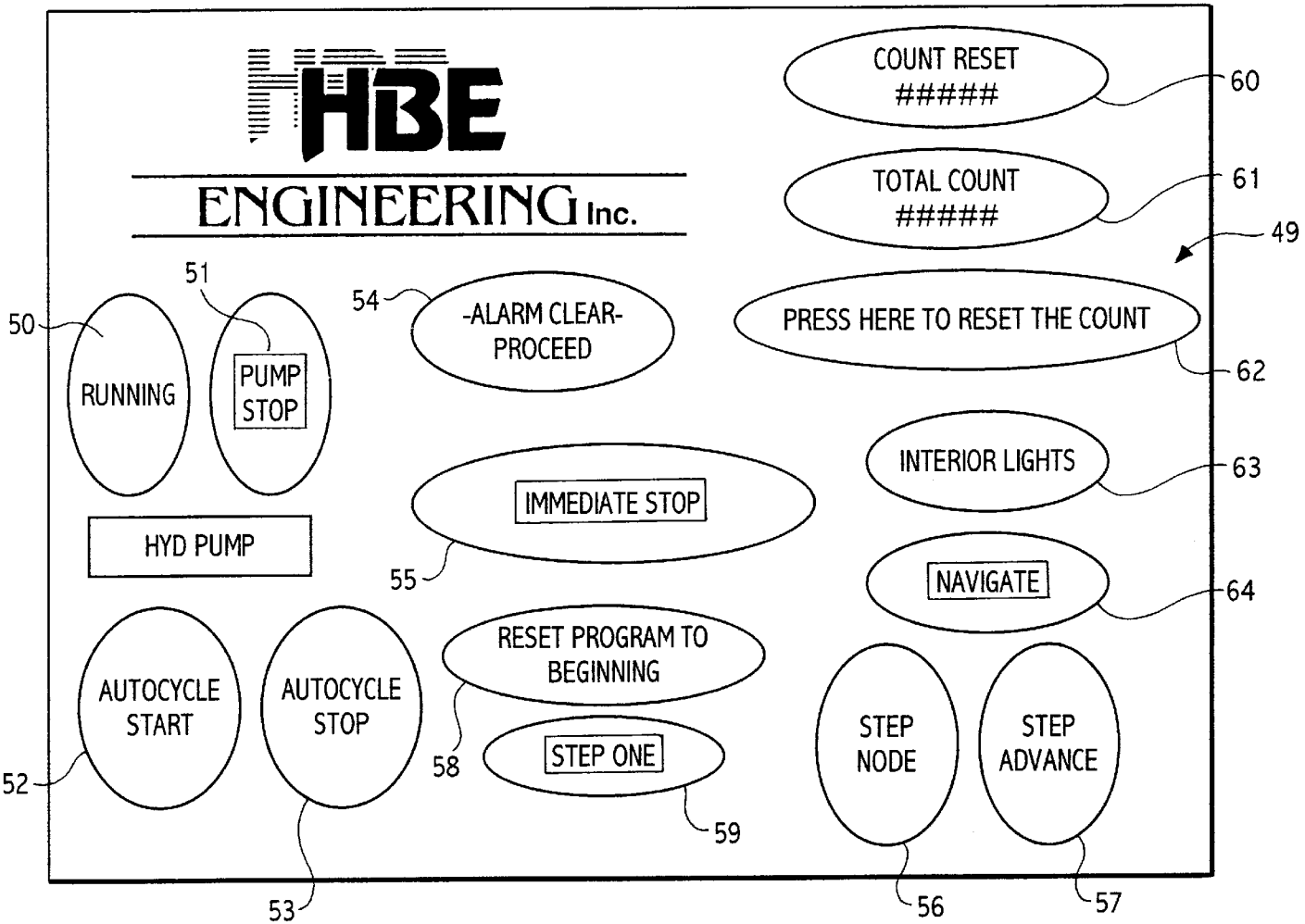

When the touch button 40 on the "Initial" screen 37 (FIG. 5), or the "AutoCycle" designation on the menu 43 (FIG. 6), is touched by the operator, the display changes to an "AutoCycle" screen 49 as shown in FIG. 7. This is an operations control screen including a "Pump Start" touch button 50 that will start the hydraulic power unit if there is not an existing fault. A "Pump Stop" touch button 51 will stop the hydraulic power unit. An "AutoCycle Start" touch button 52 will begin execution of the automatic component forming program. The first line of programmed outputs 1–4 on the menu 43 will become active and the system will examine for input signals for those outputs that have a "Position Sensing" feature toggled on. A programmed time delay between the steps will time-out, and if the correct inputs are seen, then the next line of programmed outputs will become active. Pressing an "AutoCycle Stop" touch button 53 will cause the "AutoCycle" operation to stop after the completion of the currently running component.

An "—Alarm Clear—Proceed" touch button 54 is also provided. During "AutoCycle" or "Step" operation, if there is "Position Sensing" toggled on for any output and the correct input signal is not received by the CPU 35, the system will not resume operation until the button 54 is pressed. This allows the operator the opportunity to investigate the cause of the incorrect input signal so that it may be corrected.

Pressing an "Immediate Stop" touch button 55 will stop the program execution immediately. However, this is not an E-Stop (emergency stop); the program is still active, and the outputs are energized. This feature allows the operator to stop program execution, and resume the program execution from the point of interruption, without having to reset the component forming apparatus, and without losing control of the forming process. This control is a maintained switch in that the operator pushes the button to activate the stop, and pushes it again to de-activate the stop. The program execution can then be resumed by selecting "AutoCycle Start" button 52, or can be stepped through by selecting a "Step Mode" touch button 56 and pushing a "Step Advance" touch button 57 to step through the programmed sequence.

A "Reset Program to Beginning" touch button 58 will reset the program sequence to the beginning step. During the initial loading of material, the component forming program can be used in the step mode to initially feed the material and cut-off to set the home, or zero position. Then the "Reset Program to Beginning" button 58 can be pressed to cause the program to return to the starting point. The program step executed after resetting will always be the first step in the program. A display window 59 directly below the button 58 indicates the current step in the program. After resetting, this field will show "Initial", indicating the "initialization" of the programmed sequence.

Pressing a "Count Preset" touch button 60 will cause a numeric entry keypad to appear so that the operator can enter the number of parts that he wishes to run, in any number combination, up to "65,535", and press an "Enter" symbol in the keypad. The numeric entry keypad will then disappear and the number entered will appear in the button area. This number of components can then be produced in the "AutoCycle" mode of operation, and when the total count of components produced equals the "Count Preset" number, the "AutoCycle" operation will stop. A "Total Count" display window 61 is provided to show the total of components produced since the counter was last reset. A "Press Here to Reset the Count" touch button 62 is provided to change the screen to a "Counter Clear" screen (not shown) where the operator is given the choice to "Clear" the counter, and/or return to the previous screen.

Pressing an "Interior Lights" touch button 63 will turn on a light located within the frame of the component forming apparatus. The button indicates the condition of the interior lamp with a white color when the lamp is on, and a black color when the lamp is off.

Pressing a "Navigate" touch button 64 will change the display to the "Navigate" screen 42 shown in FIG. 6. All other screens can be quickly accessed from the "Navigate" screen.

The "Step Mode" touch button 56 will initiate the "Step Mode" of operation. Once pressed, the button 56 will begin to flash, indicating that the "Step Mode" is active. The program can then be "stepped" through one sequence step at a time by pressing the "Step Advance " touch button 57. Each pressing of the "Step Advance" button 57 will advance the program forward one step at a time if the system is in the "Step Mode". If the system is not in the "Step Mode", pressing this button will do nothing.

Figure 8:
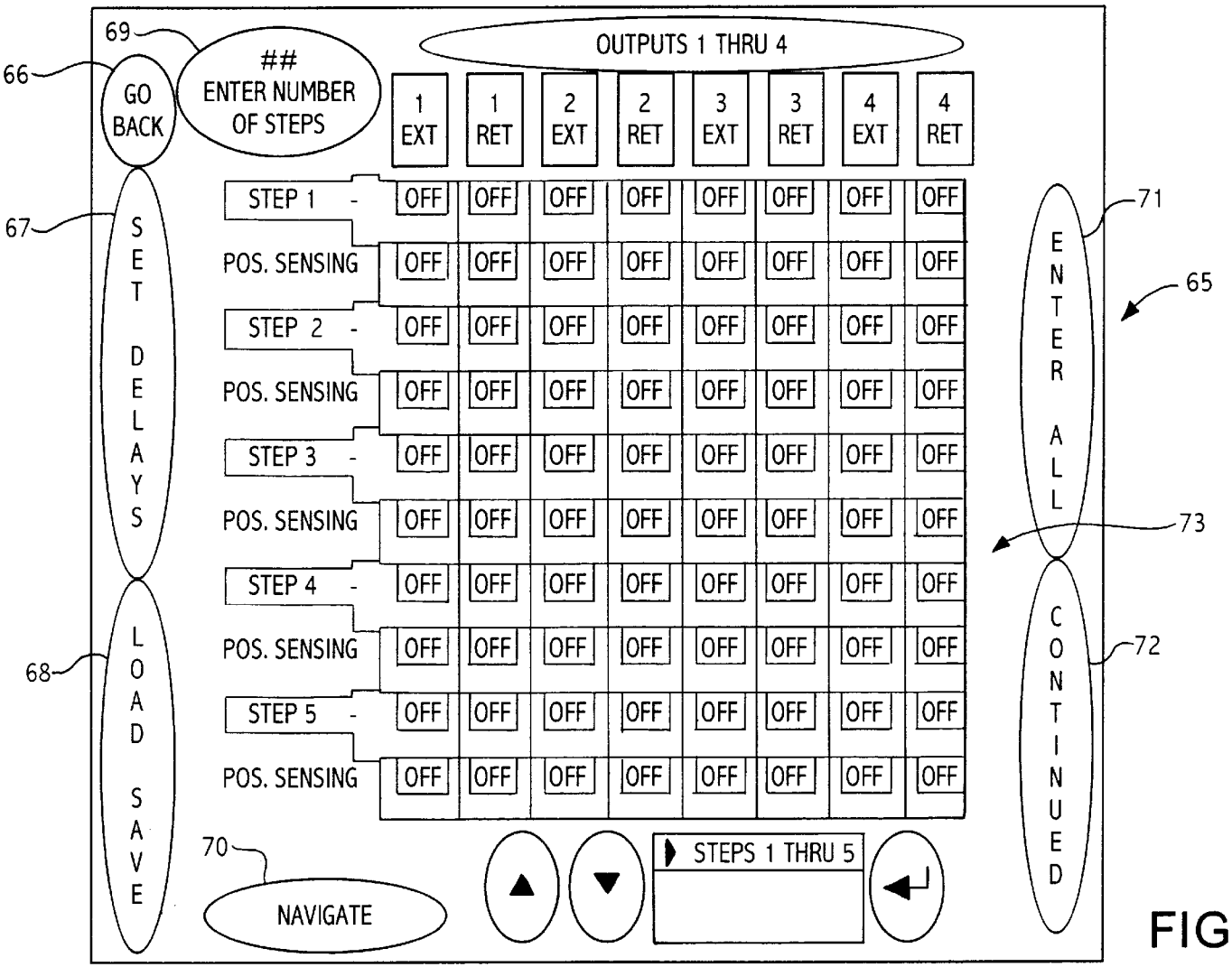

There is shown in the FIG. 8 a "Fabrication" screen 65 for the outputs 1–4. The screen 65 can be accessed through the "Fabrication" button 41 on the "Initial" screen 37 (FIG. 5) or through the menu 43 on the "Navigate" screen 42 (FIG. 6). These screens are the heart of the ease and versatility of the control system according to the present invention. All of the "Fabrication" screens are similar with only the output labels and step labels changing as the operator "pages" through the programming blocks. Pressing a "Go Back" touch button 66 will change back to the last screen viewed. Pressing a "Set Delays" touch button 67 will take the operator to a "Time Delay" screen (not shown), where the delay time between sequence steps can be set.

Pressing a "Load/Save" touch button 68 will take the operator to a "Program Load/Save" screen (not shown), where the current program can be saved, and/or another previously saved program can be loaded into the operations screens. Pressing an "Enter Number of Steps" touch button 69 will open a numeric entry keypad. The operator can enter the total number of steps in the component forming program (up to twenty steps) he wants to run and press an "Enter" key. The program will execute the number of steps entered here, even if the number entered is greater than the number of steps with programmed outputs. Pressing a "Navigate" touch button 70 will change screens to the "Navigate" screen 42 of FIG. 6. All other screens can be quickly accessed from the "Navigate" screen. Pressing an "Enter All" touch button 71 will enter the programmed switch "states" into a sequencer to be available for the forming operation. A new or edited program can be entered by pressing this button 71. Any edits to an operating program must be "Entered" to be effective.

A "Continued" touch button 72 on each "Fabrication" programming screen allows the programming of four double-acting outputs. This control allows the operator to page through these blocks of outputs, so that outputs "1" through "24" can be programmed to extend or retract. A "Step Navigation Multi-Screen Selector" area 73 is provided in the center of each "Fabrication" programming screen for programming five sequence steps. Thus, the control allows the operator to select any set of five program steps, from "1–5" through "16–20". When a screen change is made to another set, the edits made in the previous screen are automatically "Entered" in the sequencer to be available for the forming operation. This feature enables the operator to continue through the screens without having to worry about forgetting to press enter on every screen. On the last screen edited the "Enter All" button 71 control should be pressed.

The operation of the component forming apparatus 10 will now be described. To create a new program for forming a component, the operator must determine the sequence of events that must take place. Every action needed to create the new component must be programmed—every extend action, every retract action, every time delay. All tools will remain at the last position in which they were placed until they are command to move. The program sequence is entered in the "Fabrication" screens beginning with the "Fabrication" screen 65 that has Steps 1–5, Outputs 1–4. The operator presses the "Enter Number of Steps" button 69 control and enters the number of the last step on the numeric keypad which pops up. Pressing the "Enter" symbol enters the number and returns to the main screen 65. The operator then presses the cell that corresponds to the output action wanted, in the step in which it is to occur, and the cell will toggle from "OFF" to "ON". Obviously the output cannot be turned "ON" and "OFF" at the same time (during the same step), therefore pressing the "extend" of an output will turn off the "retract" of the output if it is already "On" in the same step, and conversely, pressing the "retract" will turn off the "extend". At any point in the program, the operator can select an action to be monitored by the system, by pressing the position sensing cell directly beneath the programmed output to be monitored. Each "page" or screen of outputs is completed and the "Enter All" button 71 is pressed when all the sequence steps have been entered.

Position sensing is available for any or all actuators (outputs). When selected or "On", the system will look for an "Input Signal" to confirm that the output function has been completed, (i.e. cylinder extended). This signal could come from a proximity sensor, a photoelectric eye, or a limit switch depending upon the application. A sensor 74 is shown in the FIG. 4 for determining a position (retracted or extended) of the hydraulic actuator 29. An output of the sensor 74 is connected to an input of the CPU 35 to generate the associated "Input Signal".

Figure 9:
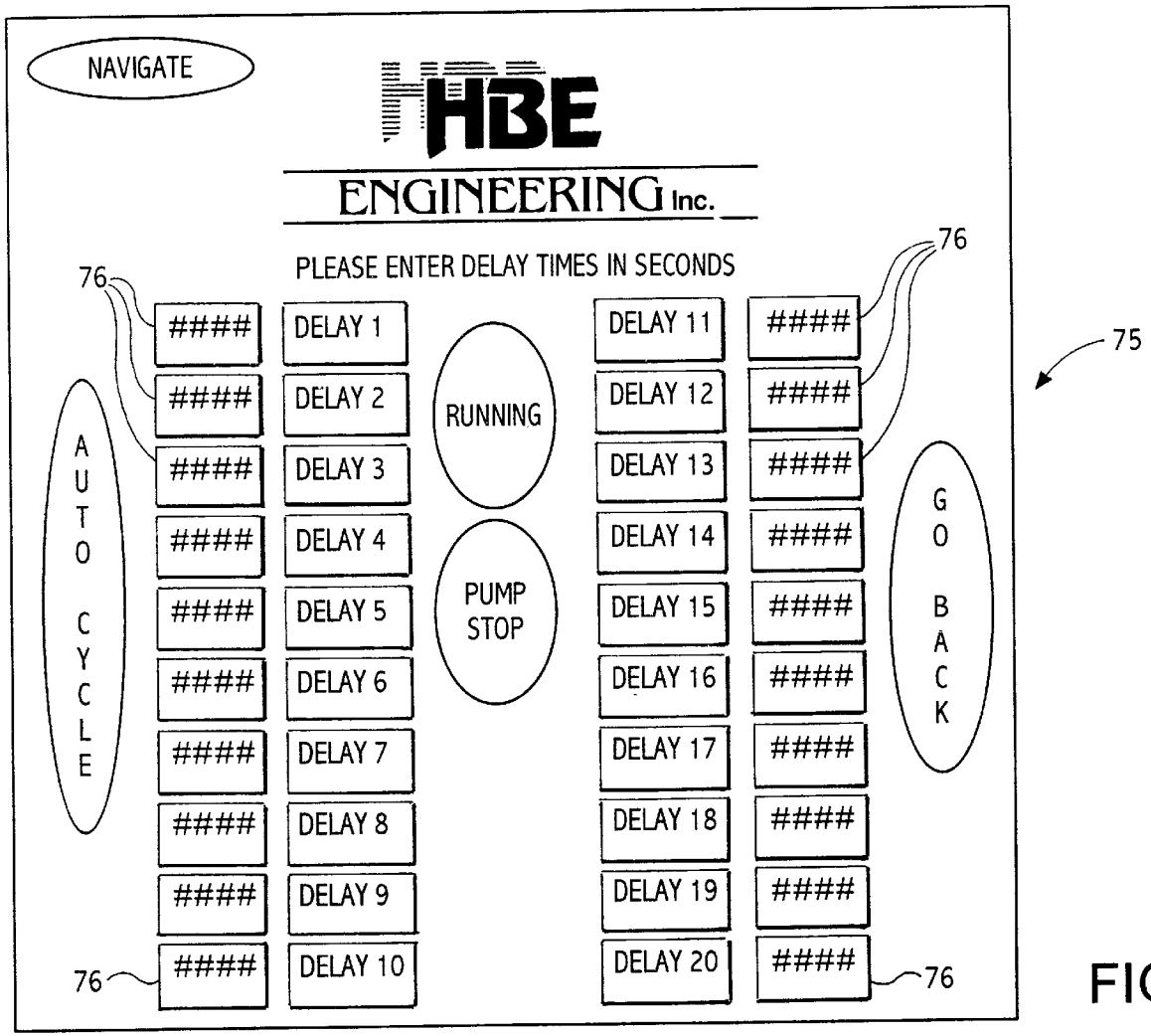

When the program sequence is completely transferred to the touch screen, the "Set Delays" button 67 is pressed and the system will automatically default to two seconds. The delay times are the time that the system has to complete a programmed step before the next step is activated. The display transfers to a "Delay" screen 75 shown in FIG. 9. The default delay times can be changed in small increments and tested to minimize delays. The delays between the steps are selectable, from 0.01 seconds to 99.99 seconds utilizing "Delay" touch buttons 76 associated with each Step 1–20. Pressing one of the buttons 76 brings up a numeric entry keypad. The delay times can be changed during operation in "AutoCycle" mode, but caution should be used, or excessively short delays could cause tooling crashes.

Figure 10:
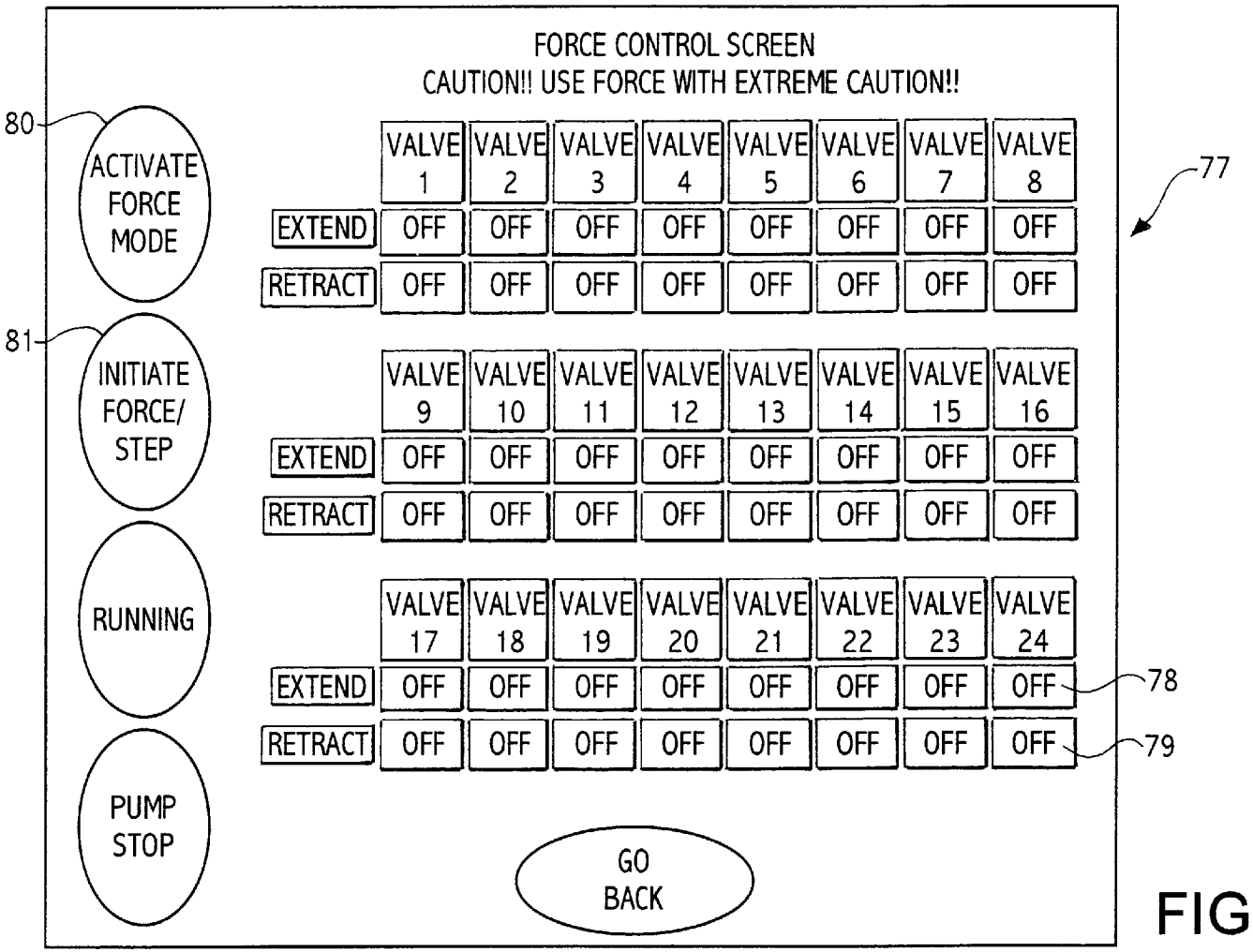

A "Force" screen 77 is shown in FIG. 10 and can be accessed from the "Navigate" screen 42 by selecting "Force Control" on the menu 43 shown in FIG. 6. From the "Force" screen 77 the operator can select and force any or all outputs on or off. This is useful in setup and adjustment of tooling, checking tool-path clearance, and verifying correct operation. To force an output, the operator simply locates the associated valve and selects the action desired to occur by pressing the screen on an "Extend" touch button 78 or a "Retract" touch button 79. The pressed button will "toggle" or change state. To de-select an output, the operator presses and holds the opposite action just until they are both on. For example, if "Extend" is selected ("On") the operator presses the "Retract" button until both buttons indicate "On", and releases. Since the same valve cannot "Extend" and "Retract" at the same time, both actions will go to the "Off" state. Now the operator must press an "Activate Force Mode" touch button 80 to enable the force mode operation. To cause the selected output action to occur, the operator presses an "Initiate Force/Step" touch button 81 and the selected output action will immediately occur.

Figure 11:
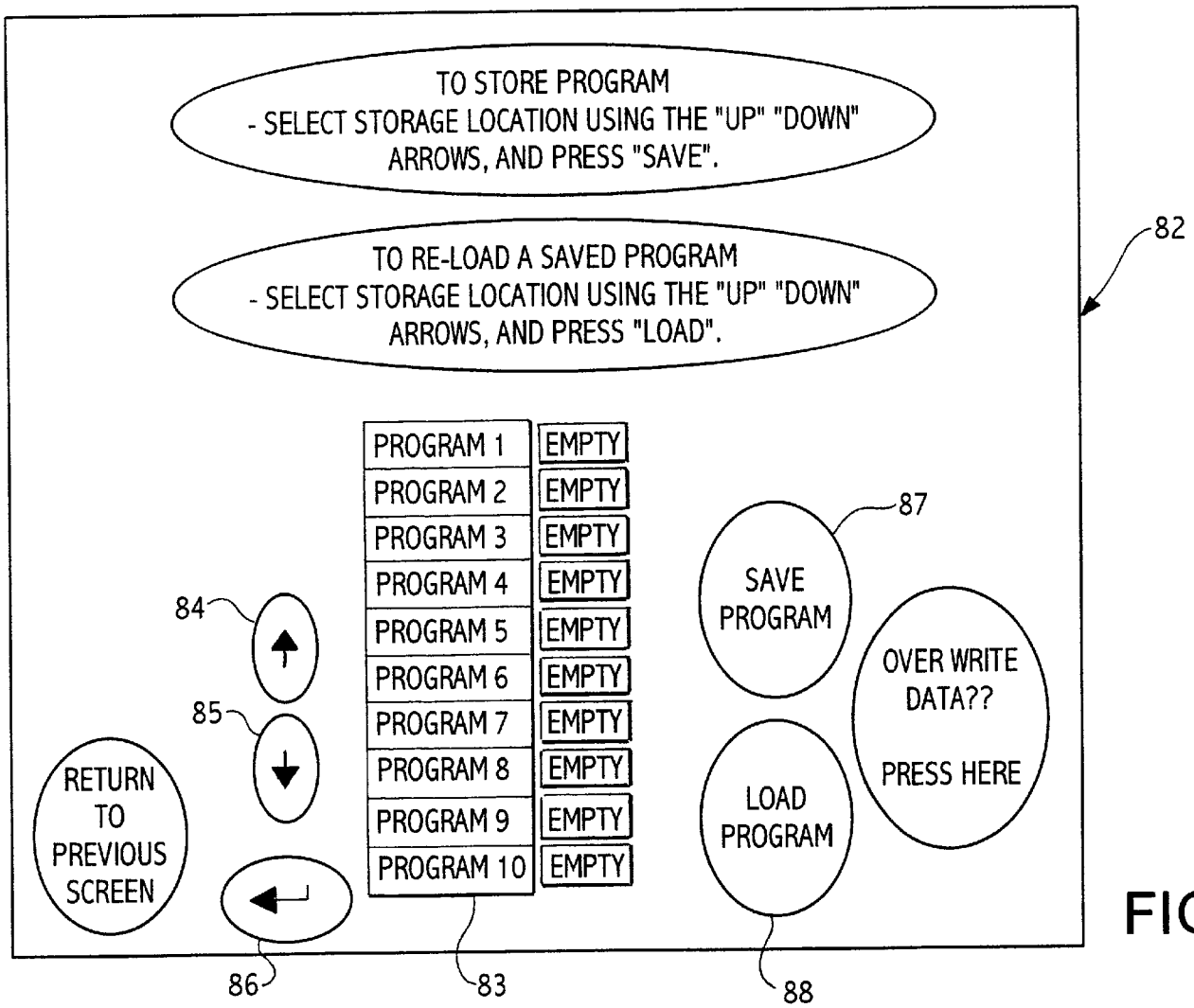

A "Load/Save" screen 82 is shown in FIG. 11 and can be reached by touching the "Load Save" button 68 on any of the "Fabrication" screens 65 (FIG. 8), or by using the menu 43 on the "Navigate" screen 42 (FIG. 6). Here the operator can save the finished program into any one of ten available file folders listed in a menu 83. To delete a program stored in a folder, the operator must save an empty program over the data in the folder. A new operating program is saved by selecting an empty folder indicated in the menu 83 utilizing an "Up" touch button 84 or a "Down" touch button 85 to highlight a folder, pressing an "Enter" symbol touch button 86 to select the folder, and pressing a "Save Program" touch button 87.

The operator also can reload any of the already saved programs into the operating system. The operator selects the desired saved program on the menu in the manner described above. Instead of pressing the "Save Program" button 87, the operator presses a "Load Program touch button 88.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for forming components from continuous stock comprising:

a stock feeder for supplying stock material to be formed;

a tool bed adjacent said stock feeder, said tool bed having a generally vertical extending front face with an opening formed therein;

at least one tooling rail attached to said front face of said tool bed and extending longitudinally across said opening, said at least one tooling rail having a front surface facing away from said opening and a rear surface facing toward said opening, said front and rear surfaces having attachment means for releasably attaching pallets to said at least one tooling rail at a selected one of a plurality of positions along said at least one tooling rail; and at least one tool pallet releasably attached to said tooling rail on a selected one of said front and rear surfaces and including at least one tool for performing a forming operation on stock material supplied by said stock feeder.

2. The apparatus according to claim 1 wherein said tool bed has a rear face with an opening formed therein for accessing said rear surface of said at least one tooling rail.

3. The apparatus according to claim 1 wherein said at least one tooling rail extends in a generally horizontal direction across said opening in said front face of said tool bed.

4. The apparatus according to claim 1 wherein said attachment means includes a slot formed in said at least one tooling rail extending between said front and rear surfaces.

5. The apparatus according to claim 1 including an actuator connected to said at least one tool, a source of pressured fluid, and a valve connected between said actuator and said source of pressured fluid.

6. The apparatus according to claim 5 wherein said source of pressured fluid provides hydraulic fluid and said actuator is a hydraulic actuator.

7. The apparatus according to claim 5 wherein said source of pressured fluid provides pneumatic fluid and said actuator is a pneumatic actuator.

8. The apparatus according to claim 5 including a control panel connected to said valve for controlling application of the pressured fluid to said actuator.

9. The apparatus according to claim 8 wherein said control panel has a touch screen for operator input of a program for automatically controlling said valve.

10. An apparatus for forming components from continuous stock comprising:

a tool bed having a generally vertical extending front face with an opening formed therein;

at least two tooling rails attached to said front face of said tool bed and extending across said opening, each of said at least two tooling rails having a front surface facing away from said opening and a rear surface facing toward said opening, said front and rear surfaces having attachment means for releasably attaching pallets to said at least two tooling rails; and at least one tool pallet releasably attached to said at least two tooling rails on a selected one of said front and rear surfaces and including at least one tool for performing a forming operation on stock material.

11. The apparatus according to claim 10 including a component guide pallet releasably attached to one of said at least two tooling rails for receiving components from said at least one tool.

12. The apparatus according to claim 10 wherein said at least one tool pallet is attached to said front surfaces of said at least two tooling rails and is supplied the stock material from a first stock feeder to form first components, and including at least a second tool pallet releasably attached to said rear surfaces of said at least two tooling rails, said at least a second tool pallet including at least one tool for performing a forming operation on stock material supplied from a second stock feeder to form second components.

13. The apparatus according to claim 12 wherein the first and second components are the same.

14. An apparatus for forming components from continuous stock comprising:

a tool bed having a generally vertical extending front face with an opening formed therein;

a plurality of tooling rails attached to said front face of said tool bed and extending across said opening, each of said tooling rails having a front surface facing away from said opening and a rear surface facing toward said opening, said front and rear surfaces having attachment means for releasably attaching pallets to said tooling rails;

at least two tool pallets each releasably attached to at least one of said tooling rails on a selected one of said front: and rear surfaces and each including at least one tool for performing a forming operation on stock material;

a source of pressured fluid;

an actuator mounted on each said at least one tool pallet and operatively connected to said at least one tool, said actuators each being connected to said source of pressured fluid through an associated valve; and a control panel connected to said valves and storing a program of forming steps required to form a desired component said control panel controlling said valves in accordance with said stored program whereby said actuators move said at least one tools to perform the forming steps on stock material.

15. The apparatus according to claim 14 wherein said control panel includes a touch screen for operator input and change of said stored program.

16. The apparatus according to claim 15 wherein said program includes a delay time value representing a delay between operation of two of said actuators and wherein an operator can change said delay time value through said touch screen.

17. The apparatus according to claim 15 wherein said program includes an on/off value for an extend operation and a retract operation for each of said actuators and wherein an operator can change said on/off values through said touch screen.

18. The apparatus according to claim 14 including a sensor for sensing a position of an associated one of said actuators, said sensor being connected to said control panel for generating a signal to said control panel representing a sensed position of said associated one actuator.

19. The apparatus according to claim 14 wherein said control panel stores a plurality of different programs, each said stored program having a sequence of forming steps required to form a different component, wherein an operator can select any one of said stored programs through said touch screen.

20. The apparatus according to claim 14 wherein said source of pressured fluid includes a hydraulic fluid source and a pneumatic fluid source and wherein actuators include hydraulic actuators connected to said hydraulic fluid source and pneumatic actuators connected to said pneumatic fluid source.

* * * * *